US008985027B2

(12) United States Patent
Brown

(10) Patent No.: US 8,985,027 B2
(45) Date of Patent: Mar. 24, 2015

(54) ZIP LINE APPARATUS

(75) Inventor: Stephen Douglas Brown, Bow, NH (US)

(73) Assignee: Alien Flier LLC, Bow, NH (US)

( * ) Notice: Subject to any disclaimer, the term of this patent is extended or adjusted under 35 U.S.C. 154(b) by 605 days.

(21) Appl. No.: 12/879,700

(22) Filed: Sep. 10, 2010

(65) Prior Publication Data

US 2011/0239898 A1 Oct. 6, 2011

Related U.S. Application Data

(60) Provisional application No. 61/320,668, filed on Apr. 2, 2010.

(51) Int. Cl.

| | |
|---|---|
| ***B61B 7/00*** | (2006.01) |
| ***B61B 3/00*** | (2006.01) |
| ***A63G 1/00*** | (2006.01) |
| ***B61B 12/02*** | (2006.01) |
| ***A63G 21/20*** | (2006.01) |
| ***A63G 21/22*** | (2006.01) |

(52) U.S. Cl.

CPC ..... *B61B 12/02* (2013.01); *A63G 21/20* (2013.01); *A63G 21/22* (2013.01)

USPC ..... 104/112; 104/53; 105/148; 105/149.2

(58) Field of Classification Search

USPC ..... 104/53, 89, 93, 112–115; 105/148–151

See application file for complete search history.

(56) References Cited

U.S. PATENT DOCUMENTS

| | | | | |
|---|---|---|---|---|
| 6,666,773 | B1 | 12/2003 | Richardson | |
| 6,670,408 | B2 * | 12/2003 | Hikichi et al. | 523/149 |
| 7,966,941 | B1 | 6/2011 | Brannan | |
| 2008/0202375 | A1 * | 8/2008 | Quattlebaum | 104/112 |
| 2009/0078148 | A1 * | 3/2009 | Cylvick | 104/53 |

* cited by examiner

*Primary Examiner* — R. J. McCarry, Jr.

(74) *Attorney, Agent, or Firm* — ZIP Law PLLC; Claire Zopf

(57) ABSTRACT

A zip line or trolley system kit for propelling a person or an object using gravity along an extended cable line suspended between two trees or towers. The zip line system having a frame with one or more wheels, an adjustable length seat, a handle and a braking system for slowing the speed of descent of the zip line system. The trolley system having at least two wheels spaced apart at a suitable distance to increase ride smoothness and improve sliding of the zip line system along the extended cable. An actuator of the braking system allows for the rider to control of the speed of descent of the zip line system.

15 Claims, 13 Drawing Sheets

ZIP LINE APPARATUS

FIELD OF THE INVENTION

The invention relates to a trolley for guiding a person or an object using gravity along an extended cable line suspended between two spaced apart objects such as trees or towers, and more specifically relates to a zip line kit or system with an easily adjustable seat and handle arrangement which in combination with a wheel and braking system for the device facilitates a safe and controllable descent along the cable line. The trolley is provided with at least two wheels spaced apart at a suitable distance to increase ride smoothness, provide sufficient space to accommodate the braking system and improve operation of the zip line system along the extended cable.

BACKGROUND OF THE INVENTION

A zip line system is a work or recreational device which allows a user to maneuver or traverse themselves, or another person, object or load by use of a trolley along a suspended line or cable generally from a higher point of elevation to a lower point of elevation using gravity, although the trolley, person, object or load may be moved in any direction along the suspended line or cable depending on the use of different forces, arrangement of the zip line system and necessity. The line or cable can be a rope, steel cable, wire or other similar elongate support, even a rigid elongate support such as a steel or wooden beam, which can be extended between two points. The line or cable and zip line system generally permits travel of the trolley along the vector defined by the cable or line. The trolley has at least a wheel and preferably a plurality of wheels rotatably supported by the trolley which in turn support the trolley upon the line or cable.

The trolley may be permanently and/or removably supported by the cable and will generally include at least a handle, sling, harness or netting affixed or suspended from the trolley to support the person, load or object. Commercial trolleys for instance for mountain climbing and eco-tourism like jungle canopy tours use a trolley to which a safety harness is secured. The safety harness is a support which is merely a set of fabric straps that are adjusted around the legs and buttocks of a person with a suspension strap that connects to the trolley or pulley system. The person is directly suspended from the trolley system and must hold onto the suspension strap as they traverse the zip line.

Known zip line systems do not have a seat to comfortably support the rider during the traverse, nor an adjustment mechanism which makes the seat easily adjustable for people of different sizes. Usually the rider dangles within the harness directly from the trolley system. Known zip line systems also generally do not have any type of handle for a rider to hold directly onto the trolley while they are also supported by the adjustable seat.

Additionally, known zip line systems do not have any type of braking system in the trolley itself and the user has little or no ability to slow themselves down, or even stop themselves during the traverse. In most current systems a rubber or cushioned bumper is positioned at the base of the cable to intercept and stop the trolley from sliding further down the cable. This provides little safety or control to the user and thus there exists a need for an improved zip line system, trolley and seat support for a zip line system as well as a brake safety device to slow the descent of the trolley and person, load or object traversing along the cable of the zip line system.

OBJECTS AND SUMMARY OF THE INVENTION

The zip line system of the present invention may be offered as a completely assembled unit or a kit with various components including for example the trolley, a braking system, handle, webbing, a seat and a trolley return line. Other components of the system could include but are not limited to a safety harness, a cable as well as structural accessories, fasteners and tools such as a come-along and cable cutters which facilitate constructing and suspending the cable between two points.

The zip line kit has an improved trolley system that supports at least one, and preferably two or more wheels sandwiched between two frame pieces. The frame pieces can be manufactured of aluminum or other metal, certain rigid plastics or other stiff durable materials such as carbon fiber could be used as well. The frames are affixed to one another sandwiching the wheels therebetween. The frames can be removably affixed for instance by bolts, screws or other such fastening devices. The frames can be permanently connected for instance by rivets or welding or even hingedly connected by a hinge or quick-release and fastening system which allows the frames to hinge along parallel or non-parallel planes with respect to one another. Such a hinge connection may facilitate taking the trolley on and off a cable without having to take the cable down or completely take the trolley apart.

In any event the trolley is securely affixed to and supported on the cable, line, rope or wire with the cable inserted through, i.e. generally in a planar relation between the two frame pieces and below the wheels, so the wheels rest on the top of the cable and support the trolley so that it can roll efficiently along and traverse the cable. It is to be appreciated that there could be an additional wheel or wheels below the cable to facilitate maintaining the trolley tracking along the cable.

A handle is secured through each of the frame pieces using cushioned grips, improving the comfort, and grip of the handle for the rider. Alternatively, a dual piece handle may be formed by engaging threadable sections which engage with one another, or which engage directly with frame pieces. The frame pieces also support fabric webbing, although a cable or rope may also be contemplated, that extends from the base of each of the frame pieces to support a seat for the zip line rider beneath the trolley. This adjustment allows the seat to be positioned at a desired distance below the handle for a rider to comfortably hold the handle essentially above their head while seated. The seat may be of aluminum, another metal or of a plastic composite with an ergonomic shape to allow for a rider to sit comfortably.

It is an object of the present invention to provide a trolley for a zip line system including a braking system including a brake pad and actuator to control the amount of braking desired by the rider as the rider slides along the cable.

It is another object of the present invention to provide an improved zip line system and trolley for traversing a cable with the trolley having an increased distance between each wheel to permit the trolley to more efficiently traverse the cable and permit the braking system to be located between the spaced apart wheels.

It is another object of the present invention to provide a zip line system with an easily adjustable seat to more comfortably accommodate riders of different sizes.

It is still another object of the present invention to secure the pulley system of the zip line apparatus within a quick release frame to allow the apparatus to be easily secured and removed from a cable, rope or wire.

It is yet another object of the present invention to have a braking system which a rider activates to slow the descent of the zip line along the cable or wire.

It is still yet another object of the present invention to have a braking system which a rider de-activates to slow the descent of the zip line along the cable or wire.

It is a further object of the present invention that the brake pad has a lining to increase frictional resistance while reducing wear on the wire or cable.

The present invention is directed to trolley for traversing a zip line system comprising a frame including at least two wheels rotatably affixed to the frame; a brake affixed to the frame for engaging an object supporting the trolley in the zip line system; a handle secured to the frame permitting a user to grasp the trolley; an adjustable seat secured to the frame; and wherein the brake is actuated by the user while grasping the handle of the trolley to control the descent of the user and the trolley along the zip line system.

The present invention is also directed to a method of carrying a person or object along an extended wire comprising the steps of attaching a pulley system to a frame, the pulley system adequate to roll along the wire; attaching a braking system to the frame to control the speed of the person or object along the wire; attaching a seat using fabric webbing to the frame, the fabric webbing being adjustable to change the distance of the seat from the frame; and attaching a handle to the frame.

The present invention is further directed to a kit for a zip line system comprising a frame; a pulley system; a braking system; one or more straps of fabric webbing; an adjustable seat; and a handle.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which:

FIGS. 2A-2E are views of the components of the zip line system kit of the present invention, including a frame, a handle a braking system, a seat and a suspension strap, respectively;

DETAILED DESCRIPTION OF THE INVENTION

Figure 1:
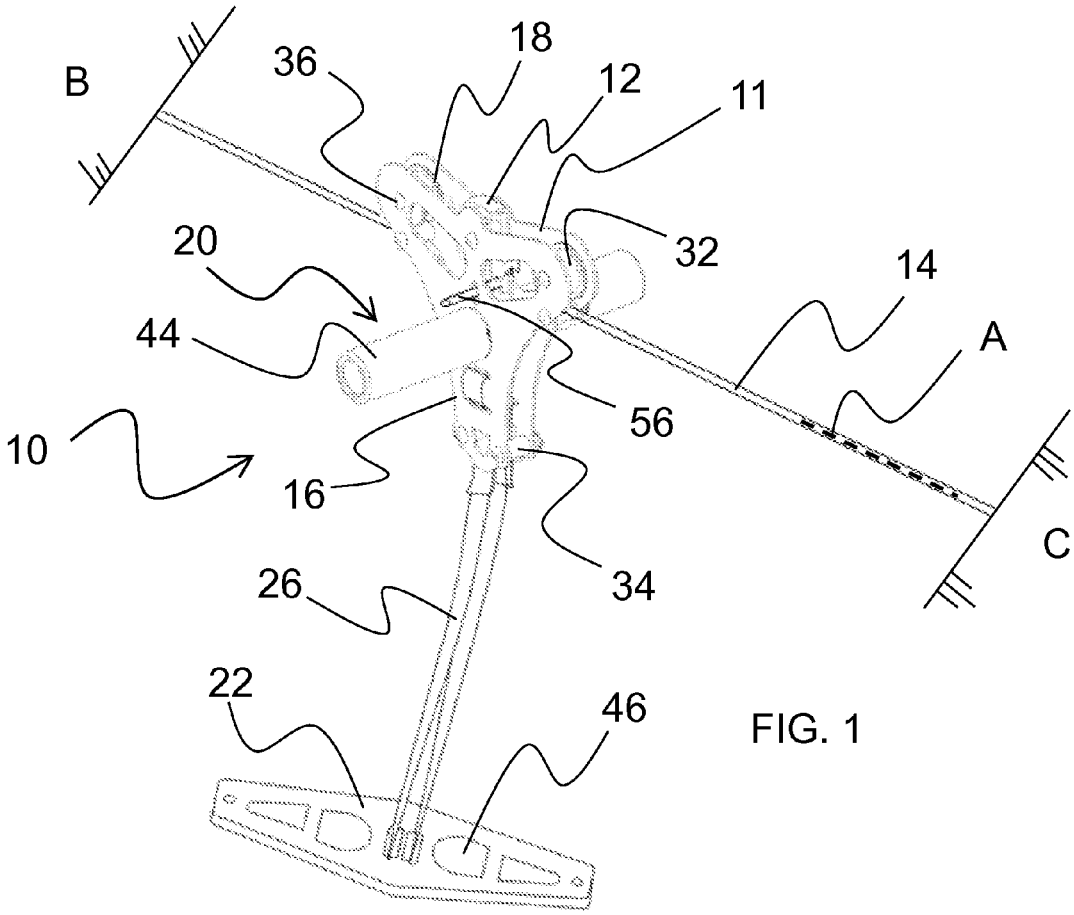
FIG. 1 is a perspective view of an embodiment of the zip line system of the present invention.

FIG. 1 shows in general a zip line apparatus 10 of the present invention including a trolley 11 with a braking system 12 supported on an extended cable 14. The trolley 11 comprises two frame pieces 16 that house one or more wheels 18 for engaging the cable 14. The cable is understood to be in one embodiment an extended steel cable, but could alternatively be a rope, line, rail or wire, but for purposes of description is hereinafter referred to as cable 14. The cable is fastened at either end between two spaced apart points B-C to generally define a longitudinal travel axis A for the trolley. The trolley 11 may also include a braking system 12, handle 20, a seat 22 and an adjustment mechanism 26 facilitating changing the spacing between the seat 22 and the trolley 11.

Figure 2:
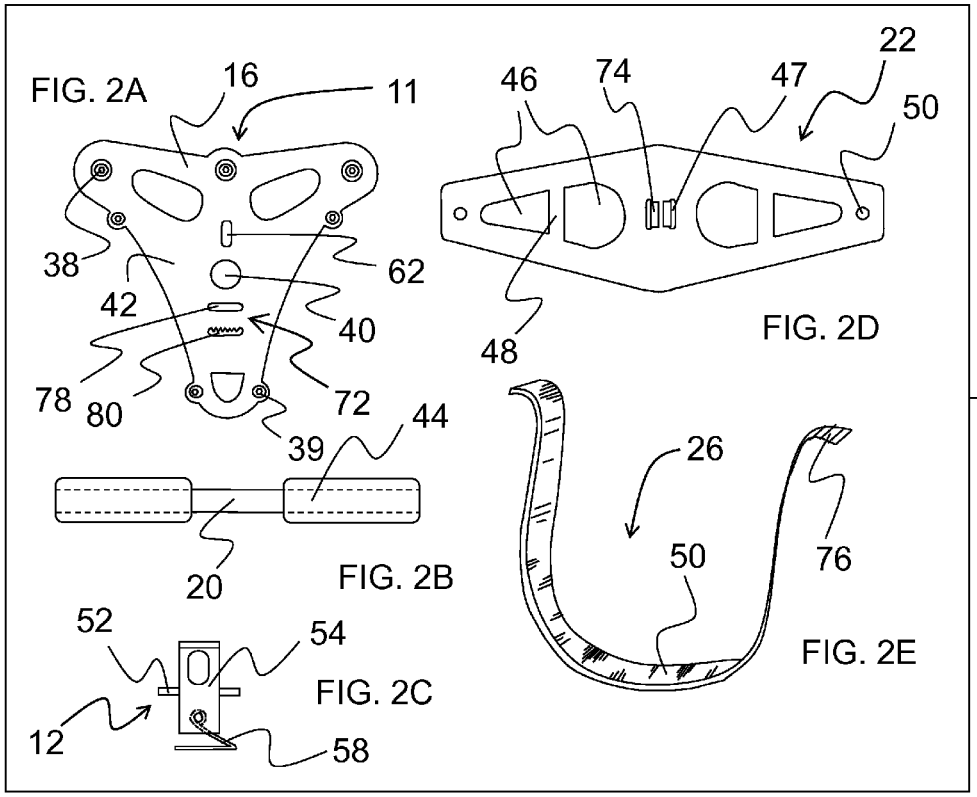
FIG. 2 is an embodiment of the zip line system kit.

A basic zip line kit 30 is shown in FIG. 2 and the components of the kit 30 are shown in FIGS. 2A-2E comprising the trolley 11, handle 20, braking system 12, seat 22, and adjustment mechanism 26, respectfully. The kit 30 could alternatively include more or less components, for example, the kit might not contain the braking system 12 if such a braking system where not necessary or desired in a certain zip line application. The kit could, by way of example, also include additional components like the cable 14 and parts for securing and extending the cable 14 between the points B-C.

The generally triangular shaped frame pieces 16 of the trolley 11 as shown in FIG. 2A define a series of pivot points 38, attachment points 39 as well as other openings and slots to facilitate the attachment of the wheels 18, secure the opposing frame pieces 16 together and position the braking system 12, handle 20, seat 28 and adjustment mechanism 26. Pivot points 38 are positioned at what are defined here as the upper opposing corners of the trolley 11 to rotatably attach the wheels 18 between the triangular shaped frame pieces 16. Two wheels 18 are used in the preferred embodiment although additional pivot points and wheels may be configured and overall dimensions of the frame pieces 16 may be altered to accommodate alternative configurations.

The center portion of the trolley has an opening 40 for the handle 20 to be inserted through or bolted onto the frame 16, the handle 20 may be a metal, wood or other similar rigid material bar or rod, which is inserted through the opening 40 so as to extend perpendicularly relative to the planar surface 42 of the frame 16 as shown in FIG. 1. The handle 20 may be round, or other profile such as square or rectangular with the opening 40 similarly designed, and be of a various diameter or width to comfortably accommodate the hands of a rider 24 gripping the handle 20 by wrapping their fingers around the handle 20.

The handle 20, as shown in FIG. 2B, may have a removable cushioned grip 44 that is slid onto or affixed onto the handle 20, providing comfort to the rider 24 and helping to secure the handle in the opening 40 where the ends of the grips 44 abut against the portion of the frame 16 surrounding the handle opening 40. In this way, the opening 40 in the frame 16 for the handle 20 may be of a diameter smaller than an outer circumference of the grip 44 providing for the grip 44 to maintain the handle 20 in the opening 40 with the trolley 11. The grip 44 may be of a stiff foam or rubber that tightly adheres to the handle 20, but is generally manually removable if necessary to remove the handle 20 from the trolley 11.

One embodiment of a seat 22 and the adjustment mechanism 26 as flexible fabric webbing is shown in FIGS. 2D and 2E. The seat 22 may be of any ergonomical design and material to comfortably and safely support a rider 24. In the embodiment of FIG. 2D, the seat is designed to be sat upon by the rider with the seat 22 arranged under the user's hamstrings and/or gluteus maximus. The general diamond shape of the seat 22 here facilitates the rider sitting upon the seat and essentially straddling the webbing of the adjustment mechanism 26. The seat 22 may be other shapes, and may be rigidly formed from a piece of metal, such as aluminum, or the seat may be flexible, i.e. a flexible fabric or plastic such that the flexible seat conforms to the riders body size and shape. This is an important safety consideration since a flexible seat would be able to bend around the body proportions of any size rider from child to adult, and securing them closely without changing the size of the seat for different riders. In either a rigid seat or a flexible seat, the seat may have cutouts 46, slots 47 or other openings 50, which define alternative securing points to allow flexibility in attachment of the seat 22 to the adjustment mechanism 26.

The adjustment mechanism 26 is in one embodiment fabric webbing 50 of a reasonable length, generally between for instance 2.44 m-4.57 (8-15 feet) long, to provide sufficient adjustment between the seat and trolley for the size of the rider. The critical distance for which the adjustment mechanism 26 is adjusted is based on the extension of the rider's arms over their head to grasp the handle 20 while sitting on the seat 22 so that their head is entirely below the trolley. In other words it is the distance between the handle 20 and the seat 22 which permits the rider to sit comfortably on the seat 22 and reach over their head and grasp the handle 20 so that they are securely suspended below the trolley 11 and upon the seat 22. For a child the webbing would be adjusted to shorten the distance between the seat and trolley, and for an adult of course the webbing 50 would be lengthened to provide a greater distance therebetween.

Although other ways of adjusting the relative seat and trolley distance are possible, webbing is a good choice for the adjustment mechanism because of its flexibility and tensile strength. The flexibility enables the user to easily adjust the length of webbing to accommodate a rider. Webbing is inexpensive, strong and available in a myriad of widths. An appropriate size for the adjustment mechanism 26 is a width of between about 1.91 cm-3.81 cm (¾" to 1/½") and preferably 1" with a tensile strength of ~15 kN-~35 kN (~3000 lb.-~7000 lb.) and more specifically a tensile strength of ~20 kN (~4000 lb). The webbing is preferably resistant to mildew, aging and abrasion. Alternative adjustments and attachments of the frame to the seat are discussed in detail below.

The braking system 12 as shown in one embodiment in FIG. 2C is also supported within the frame 16 of the trolley 11 and generally includes a brake pad 52 aligned anywhere adjacent the cable 14 for contacting the cable, although the most practicable alignment is above or below the cable 14 for contacting the cable 14 when the braking system 12 is operated by the rider. The brake pad 52 may have a contact length which depends on the amount of friction desired to be generated during braking operations. The contact length of the brake can be extended to the full length between the wheels 18 or to any desired length to sufficiently contact the cable 14 and create a frictional resistance to slow the trolley system 10 down upon actuation of the braking system. The brake pad 52 may be retained and float above the cable 14 using a tension spring or below the cable 14 resting on support or spacer 34 prior to activation. By floating adjacent the cable the brake pad 52 may be in light contact with the cable 14 and ride along the cable without creating much braking friction until energized by the rider. The brake pad 52 may also be provided with a contact surface which is angled or curved to provide additional frictional contact with the cable 14.

Figure 3A:
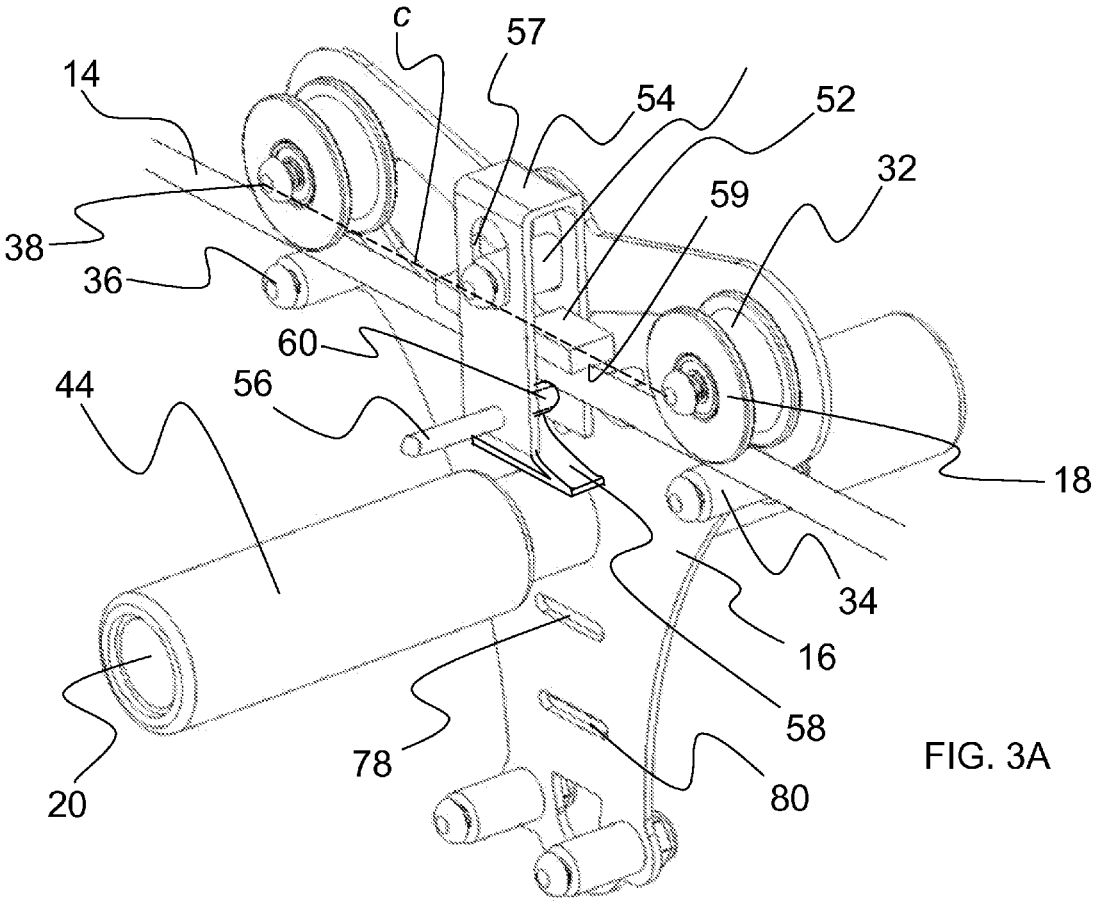
FIG. 3A is a perspective view of a first embodiment of the frame and brake assembly for an embodiment of the zip line system of the present invention.

Turning to FIG. 3A, in one embodiment, the two wheels 18 may be positioned at the upper corners of the trolley 11 providing spacing between the pivot points 38 in a range of at least 10.2 cm to 20.3 cm (4" and 8") and more specifically at a distance c of 11.4 cm to 14 cm (4½" to 5½"). The wheels 18 are secured in the trolley 11 and thus along the cable 14 at an increased distance relative to known zip line systems so that rider, load or weight is distributed along a greater length and surface area of the cable 14 reducing tension and bending of the cable, giving the rider a smoother ride. The wheels 18 are generally fabricated of stainless steel, brass or other durable material with sealed, internal or external bearings 27 to optimize rolling and rotation of the wheels and trolley along the cable 14. Such wheels 18 are often referred to as a sheave which is a wheel or roller with a groove 32 along its edge for engaging a belt, rope or cable 14. When hung between two supports equipped with a belt, rope or cable 14, one or more sheaves make up a pulley, or as in this case are embodied as the trolley 11. The words sheave and pulley may be sometimes used interchangeably.

Spacers 34 may be positioned between the frame and the connecting bolts 36 of the frame 16 and additionally at an offset to the pulleys 18 to act as a guide for the cable 14 along the pulley 18. Optionally runners or brackets (not shown) may also be positioned offset from the pulleys to act as cable guides.

Figure 3B:
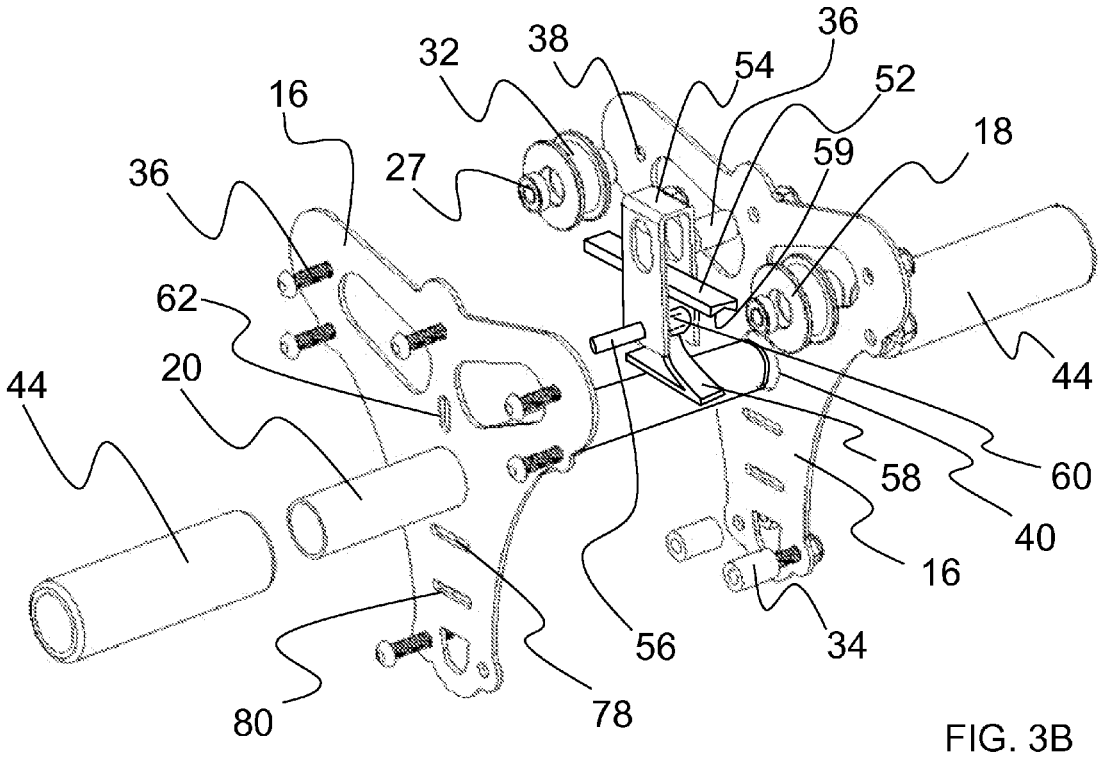
FIG. 3B is an exploded view of a first embodiment of the frame and brake assembly for an embodiment of the zip line system of the present invention.
Figure 3C:
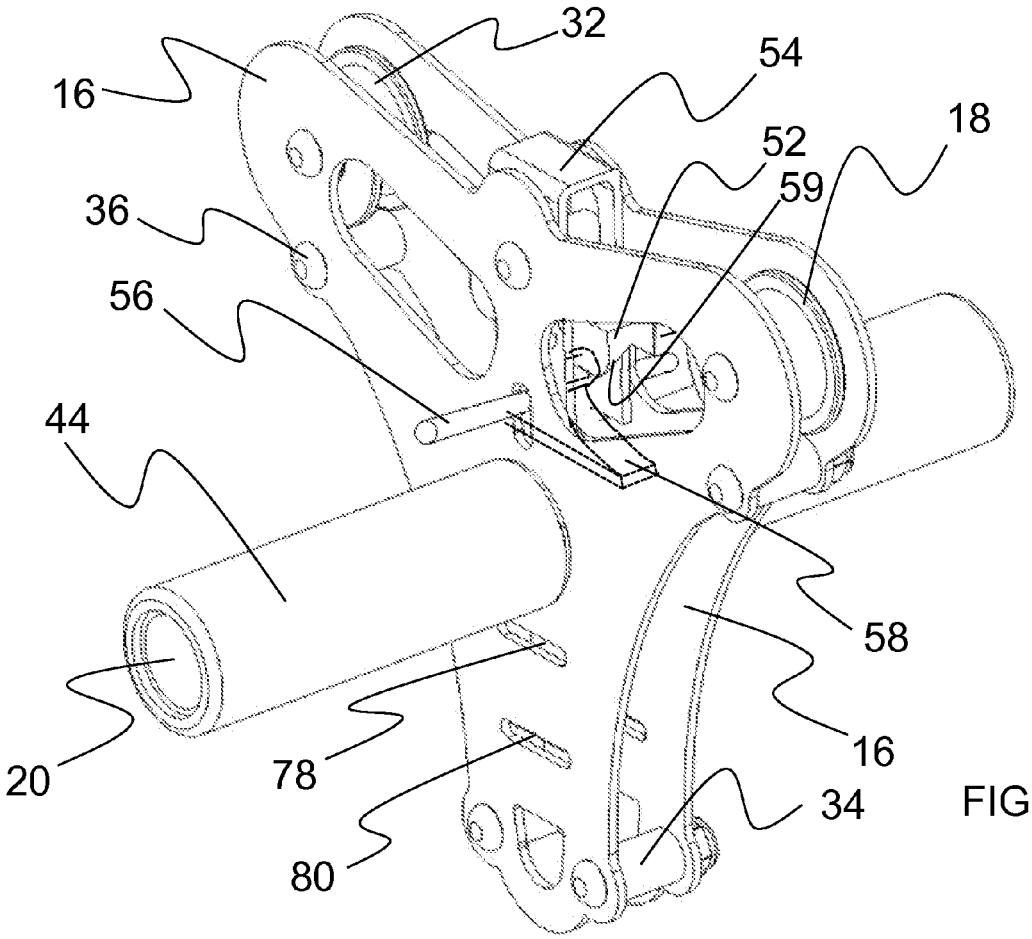
FIG. 3C is a perspective view of an embodiment of the zip line system with a first embodiment of the frame and brake assembly.

In the embodiment as shown in FIGS. 3A-3B, a U-shaped brake frame 54 is affixed in the frame 16 by a center connecting pin 36 and the brake frame 54 supports the brake pad 52 above the cable 14. The brake frame 54 has an elongate slot 57 in which the center connecting pin 36 permits the brake frame 54 to move linearly up and down. In this embodiment, a leaf spring 58 is depicted, although any spring or retention support may be contemplated, to maintain the brake frame 54 in a disengaged position shown in FIG. 3A. The leaf spring 58 has one end abutting the handle 20 and another end biasly engaging the brake frame 54 to maintain the brake frame 54 in a normally raised position, holding the brake pad 52 above, or in very slight or tenuous contact with the cable 14. The brake pad has a cable engaging surface 59 and may be formed from a metal bar of steel, aluminum or other metals as shown in FIG. 3A. The cable engaging surface 59 may be flat or it may be angularly formed or rounded to increase the overall contact area of the brake pad 52 with the cable 14 as shown in FIG. 3B-3C. The brake pad cable engaging surface 59 may have a lining of a heat resistant material with a desired durability and coefficient of dynamic friction in a range of 0.35 to 0.42 meaning a force of 1000 kg (or pounds) will result in a brake force close to 400 kg (or pounds).

As shown in an exploded view of the frame 16 and brake system in FIG. 3B, the actuator 56 is coupled to the brake frame 54 and inserted through both legs of the U-shaped brake frame as shown. A central portion 60 of the actuator 56 provides a bearing or attachment point for a second end of the leaf spring 58 so that the leaf spring can directly influence the brake frame 54. Alternatively, the second end of the leaf spring 58 can be directly affixed to the brake frame 54.

The actuator 56 is essentially a trigger for the user to actuate the brake. The ends of the actuator 56 pass through a brake pin slot 62 in each frame piece 16, where the slot 62 is located above the handle opening 40 to allow for a rider 24 to easily grasp the brake actuator 56 with one or more fingers while still holding the handle 20. In the present embodiment, with their hands grasping the handles 20, the rider 24 can easily extend their pointer finger on either side of the trolley to engage the actuator 56 while continuing to maintain their grip on the handle 20. In this way the rider can compress the actuator 56 to pull down the brake frame 54 and brake pad 52 against the bias of the leaf spring 58 and so fully engage the brake pad 52 with the cable 14. As the brake pad 52 contacts the cable 14, frictional resistance between the brake pad 52 and cable 14 is increased creating drag on the cable slowing the trolley 11 along the cable 14.

The actuator 56 inserted through the brake pin slot 62 in the frames 16 of the trolley 11 as shown in FIG. 3C facilitates easy actuation of the brake. The positioning of the actuator immediately above the handle 20 is ergonomically appropriate even for small or inexperienced riders. The ability for a rider 24 to grasp the actuator 56 while holding the handle 20 and pull down whenever the rider feels their speed is too great is critical as it allows the rider to hold or release the brake 12 in any desired manner to control their rate of travel, generally descent, along the cable 14.

Figure 4:
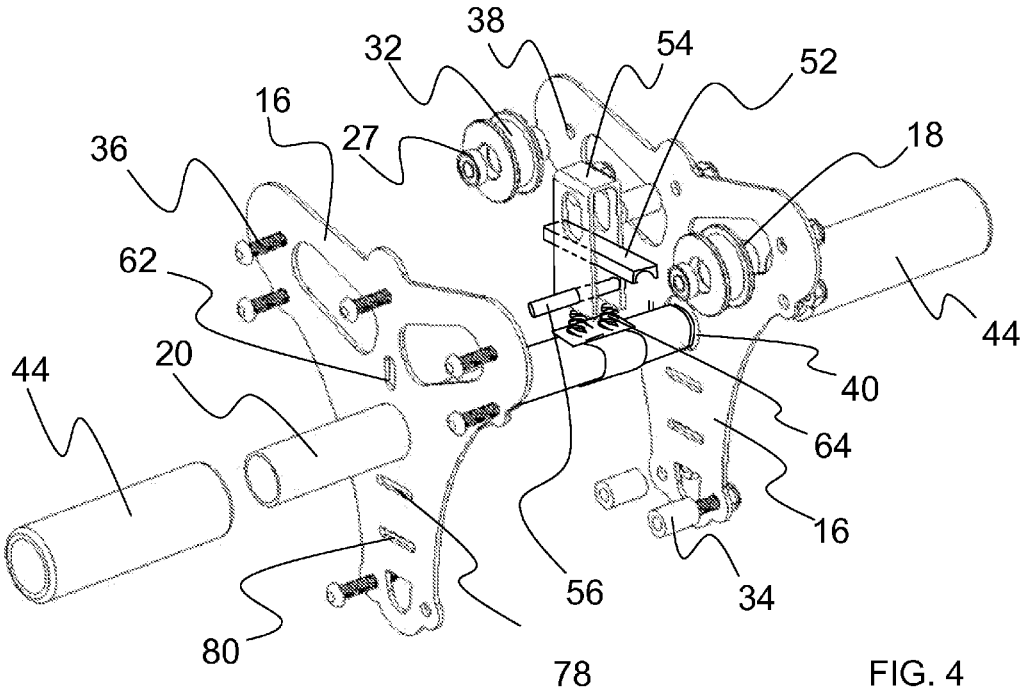
FIG. 4 is an exploded view of a second embodiment of the frame and brake assembly for another embodiment of the zip line system of the present invention.

In an alternative embodiment as shown in FIG. 4 the brake frame 54 is supported in the disengaged position by one or more coil springs 64 influencing the brake frame 54. A spring support 66 may be snapped or clamped on to the handle 20 or otherwise affixed to the frame 16 or brake frame 54. Similar to the previous embodiment, the actuator 56 is inserted through the frame 16 and the brake frame 54 and actuated by pulling down the brake frame 54 and brake pad 52 using the actuator 56 to bring the brake pad 52 into contact with the cable 14.

Different types of springs and biasing devices may be used to bias the brake frame and brake pad 52. In an alternative device, the brake pad 52 may be positioned below or to the side of the cable 14 with the coil springs 64 holding the brake frame 54 and brake pad 52 below and/or away from the cable 14. The rider would then operate the actuator 56 to engage the braking system 12 and slow or stop the descent of the trolley along the zip line system 10.

Figure 5A:
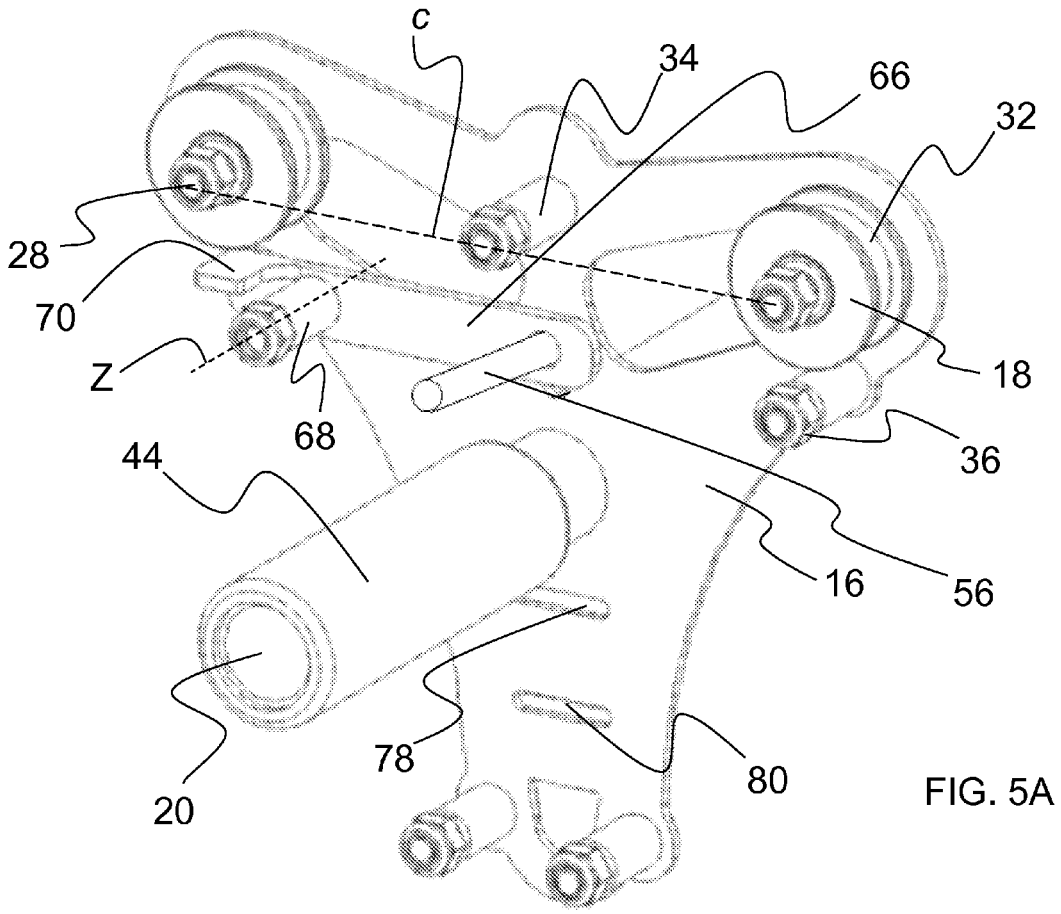
FIG. 5A is a perspective view of a second embodiment of the frame and brake assembly for another embodiment of the zip line system of the present invention.
Figure 5B:
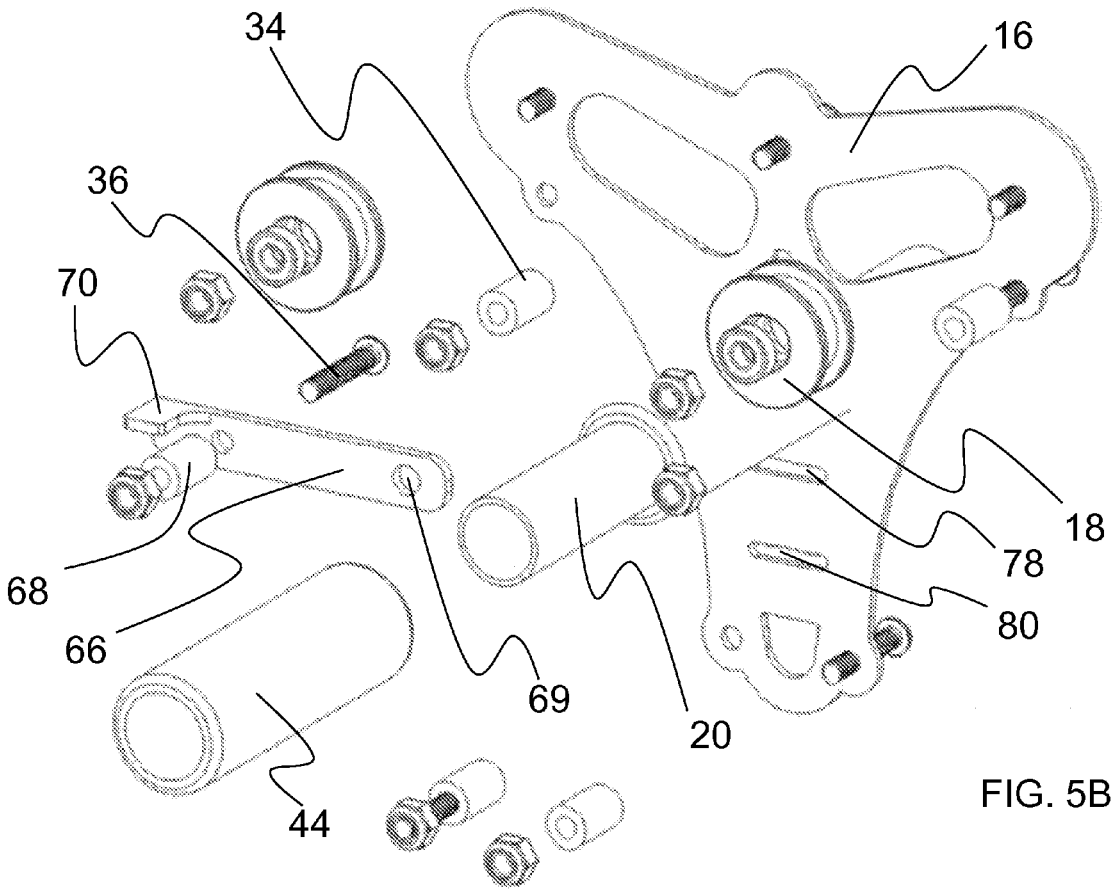
FIG. 5B is an exploded view of a second embodiment of the frame and brake assembly for another embodiment of the zip line system of the present invention.
Figure 5C:
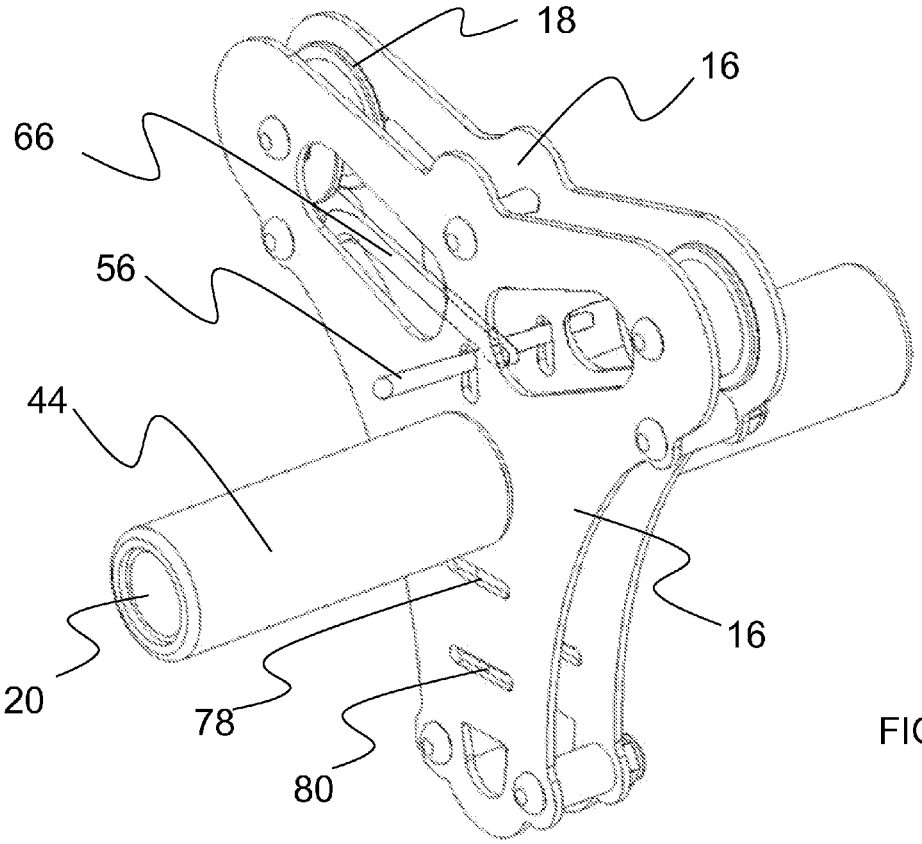
FIG. 5C is a perspective view of another embodiment of the zip line system with a second embodiment of the frame and brake assembly.

In a further embodiment, the braking system 12 may be a simple lever pin 66 that is affixed to the actuator 56 and pivots on an axis Z around a lever midpoint, such as the connecting bolt 36 as shown in FIG. 5A. The use of a smaller spacer 68 would allow the lever to be secured within the frame 16, but also provide for an axis of rotation of the lever pin 66 about the bolt 36. The lever pin 66 may have a brake pad 70 that extends along an entire length of the lever 66 from the actuator 56 to the pulley 18 or as shown in FIGS. 5A-5C a smaller surface area that contacts the wire 14 immediately at the pulley to curb rotation of the pulley 18 and slow the descent of the zip line system 10. As shown in FIG. 5B, the actuator 56 is inserted through an opening 69 in the lever pin, allowing the pin to swing down and pivot around the Z axis and force the opposing end of the lever pin 66 having the brake pad 70 to contact the cable 14.

As noted above the lever pin 66 may be positioned below the cable 14 as shown, or alternatively be positioned above the cable 14 by shortening the length of the lever 66 and repositioning the axis point Z perpendicular to a point in the center of the frame 16 near the area of the brake pin slot 62. The actuator 56 and brake pin slot 62 would then be positioned at the opposite end of the lever brake pad 70 and be pulled or pushed up to actuate the braking system 12.

The lever pin brake pad may have a heat resistant lining made of a material with a high coefficient of dynamic friction as described above. In this embodiment with a simple lever, a spring may not be necessary if the brake pad 70 is permitted to merely float or glide along the cable 14 in the disengaged position and operation of the actuator 56 provides a greater frictional force from the brake pad 70 to the cable 14.

The present invention is not intended to be limited to only the braking systems described above. Other braking system structures could also be used to slow the trolley 11, for example a braking system where the brake is generally in an actuated state, i.e. firmly gripping the cable and the actuation of the actuator 56 causes the braking system to essentially release the cable 14. In this way, a rider would actively control their descent by releasing the brake a desired amount, and if their hands came off the trolley 11 and/or released the brake 12, the trolley 11 would immediately slow due to the influence of the brake 12 on the cable 14.

Figure 6A:
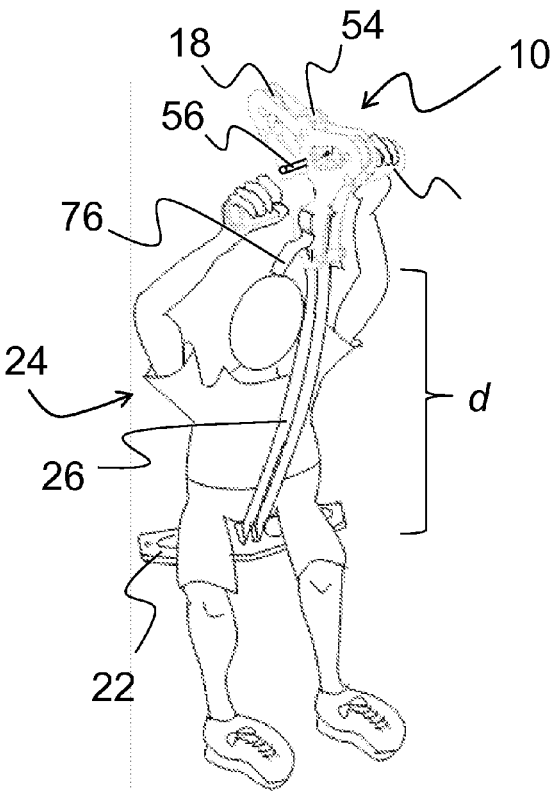
FIG. 6A-6B are perspective views of an embodiment of the adjustable seat for an embodiment of the zip line system of the present invention.
Figure 6B:
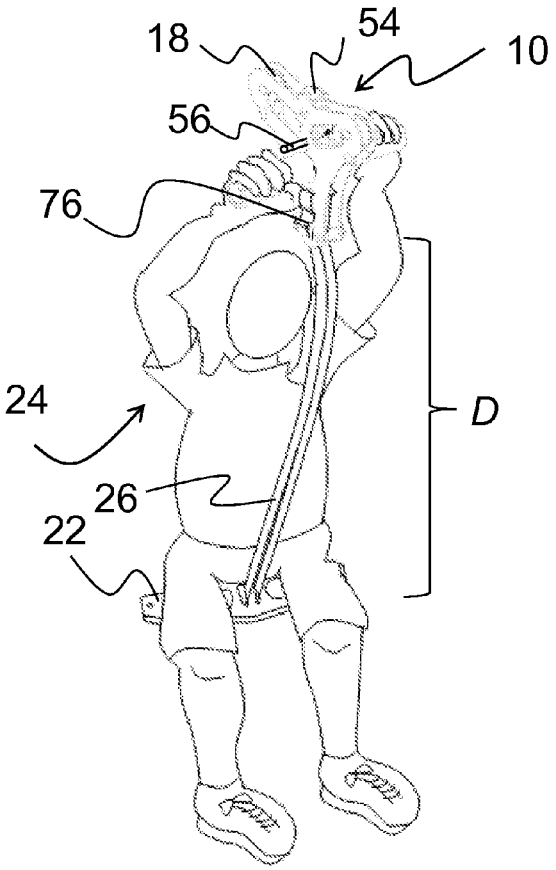

The present invention also provides for alternative methods of attaching the frame assembly 16 to the seat 22 which supports the rider 24. As shown in FIGS. 6A and 6B the frame 16 has a series of adjustment openings for linking and tightening the support webbing 26 to attach the seat or harness to the frame 16. The support webbing 26 is first attached to the seat 22 by looping one or more straps of webbing 26 through one or more slots 47 or openings 50 in the seat or around a seat attachment beam 48. A plastic roller 74 may be affixed to or snapped on to the opening or beam to smooth the surface edge and prevent cutting of the seat 22 into the strap 26. The first end of the webbing 26 may be secured to the seat 22 or alternatively the strap 26 is looped through and around therefore providing two ends of the webbing 26 for attachment to the frame 16.

In a first embodiment, the webbing 26 is inserted through two attachment beams 48 and each webbing end 76 is drawn up to each of the two frame pieces 16, with one end being looped through a first upper slot 78 of a first frame piece 16 and the other end being looped through a first upper slot 78 of the other frame piece 16. Each of the webbing ends 76 for each frame piece 16 are then inserted through a lower slot 80 having teeth to grip the webbing 26 and secure the webbing at a specific length and position. As shown in FIG. 6A, by inserting a longer length of webbing through each slot (78, 80) the distance d from the seat 22 to the frame 16 is shortened for a smaller rider 24 as compared to the distance D in FIG. 6B. For a taller rider 24 with longer arm length, a shorter length of webbing is inserted through the slots (78, 80) leaving a greater distance between the seat and the frame and leaving a shorter length of webbing extending from the toothed slot 80. The webbing 26 may be adjusted to any length that is comfortable for the rider.

Figure 7A:
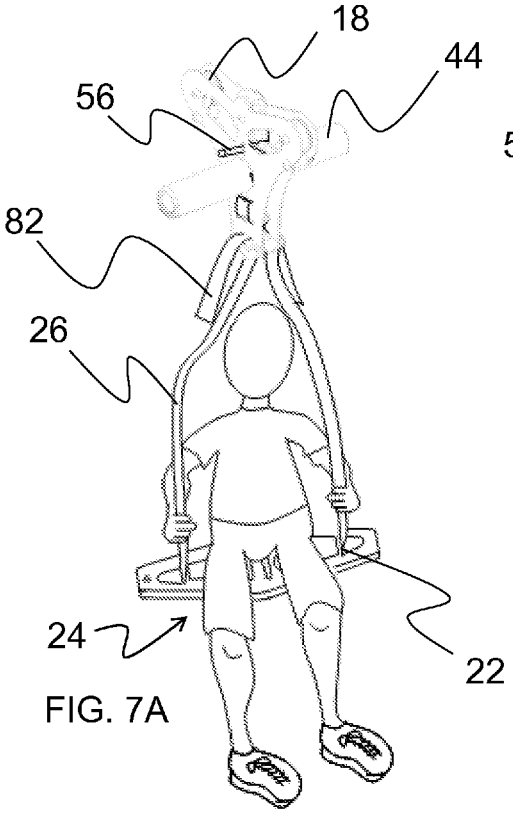
FIG. 7A-7B are perspective views of a further embodiment of the adjustable seat for an embodiment of the zip line system of the present invention.
Figure 7B:
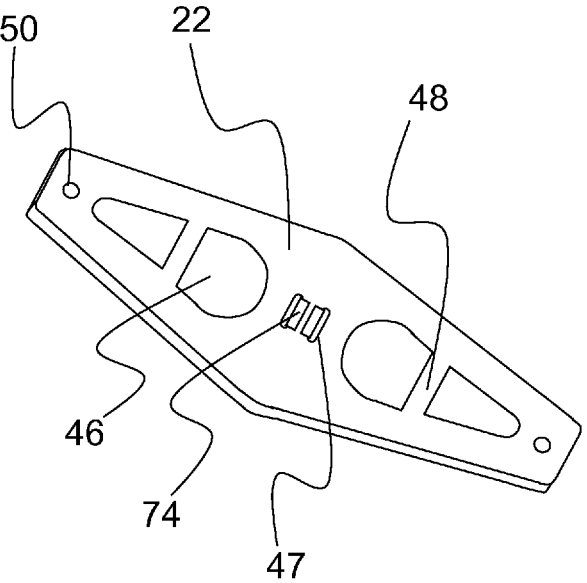
Figure 8:
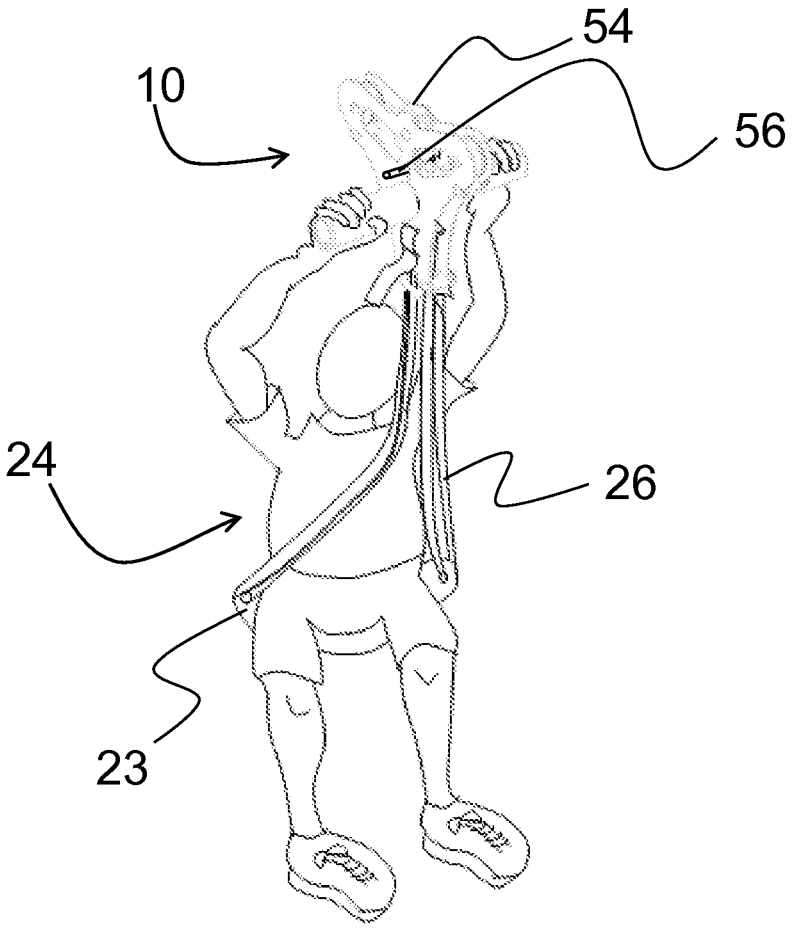
FIG. 8 is a perspective view of further embodiment of the adjustable seat for an embodiment of the zip line system of the present invention.

In a further embodiment as shown in FIGS. 7A and 7B, one or more straps of webbing 26 may be attached or looped around attachment beams 48 or openings 50 on either end of the extended end of the seat 22 to form a swing to accommodate even smaller riders that may more easily hold onto the straps rather than the over head handle 20. A preferred embodiment of the seat with a number of alternative attachment points using cutouts 46, beams 48 or openings 50 is shown in FIG. 7B, but numerous seat configurations are contemplated to safely support and adjust distances of the frame to the seat for comfort of the rider. In a further embodiment the number of openings 50 may be increased in number and size to provide for a leg and buttocks harness to be attached to the seat 22 to provide additional support and security to the rider. It is to be appreciated that the seat may also be a flexible seat 23, such as a playground swing seat, supported on both ends and which is pliable enough to form around and hug the rider's body when the rider 24 sits in the middle of the seat as shown in FIG. 8. The rider 24 may hold on to the straps or alternatively reach around the straps to hold onto the handle 20, allowing the pliable seat 23 and straps to curve around and safely secure the rider 24.

Figure 9:
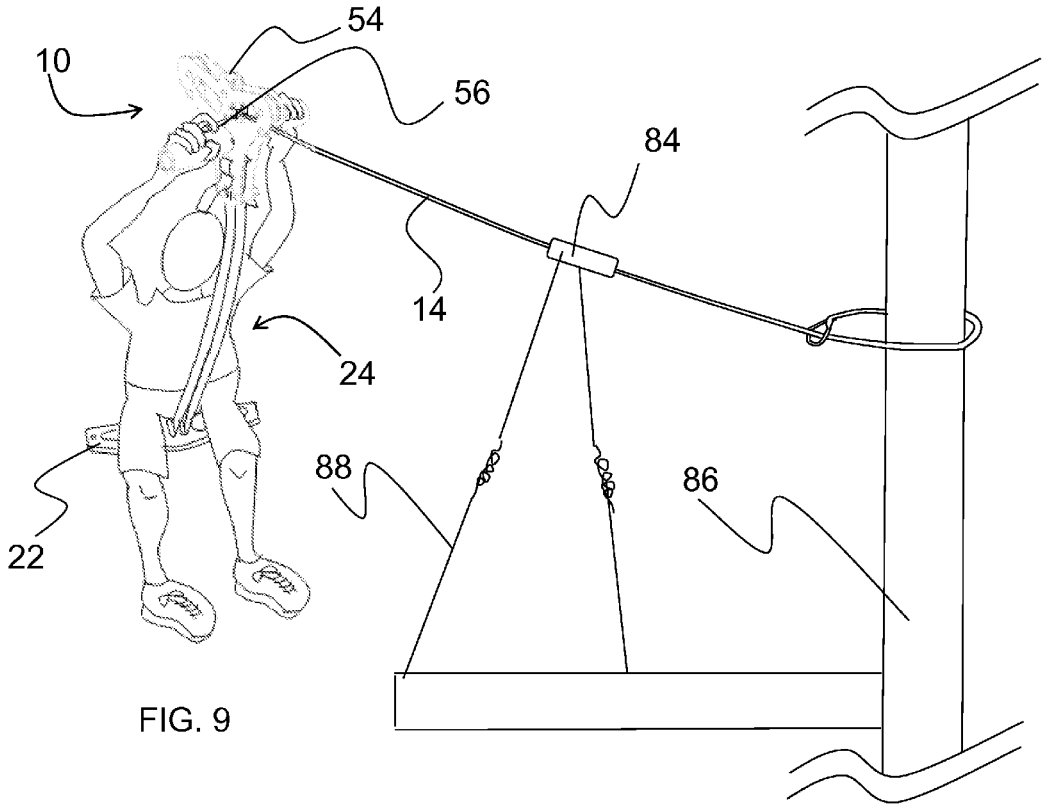
FIG. 9 is a perspective view of an embodiment of the zip line system of the present invention with cable and tower.

Actuation of the braking system as shown in FIG. 9, allows the rider 24 to slow down the zip line system 10, prior to reaching the end of the cable 14. Alternatively to the above described braking systems or in conjunction therewith, the trolley 11 can be stopped at the desired end of descent by a bumper or stopper 84 of a durable polymeric material such as high-density polyethylene (HDPE) or other comparable materials positioned close to the end of the cable 14. The bumper 84 may be supported on the cable 14 and attached to an anchor point or points by shock cords 88, or other type of force absorbing material which permits the bumper 84 and hence the trolley 11 to absorb all or some of the forces developed by the trolley 11 along the zip line and bring the trolley 11 to a safe stop. The braking system 12 provides additional safety and control to the rider to slow their descent and safely reach the ground or tower. The trolley braking system 12 and bumper 84 also provide control to the rider to ease the zip line system 10 to a stop in preference to bumping into the ground or an object and causing injury.

The invention has been described in detail with particular reference to certain preferred embodiments thereof, but it will be understood that variations and modifications can be effected within the spirit and scope of the invention.

What is claimed is:

1. A trolley for traversing a zip line system comprising:

a frame including at least two wheels rotatably affixed to the frame, the at least two wheels for engaging a top surface of an extended cable of the zip line system, wherein an outer surface of the wheels does not extend past an outer edge of the frame;

a braking system comprising a brake affixed to the frame for engaging an object supporting the trolley in the zip line system;

a handle secured to the frame permitting a user to grasp the trolley;

an adjustable seat secured to the frame via a single fabric webbing strap;

an actuator for controlling an amount of braking of the zip line system, the actuator comprising a trigger that passes through a slot in the frame that is disposed above the handle adapted to allow a user to engage the actuator with one finger while grasping the handle with two or more fingers;

wherein the brake may be actuated by the user while grasping the handle of the trolley to control the descent of the user and the trolley along the zip line system; and wherein the handle is substantially horizontally-centered between the at least two wheels.

2. The trolley of claim 1, wherein the wheels are positioned on the frame at a distance of at least about 10.2 cm to about 20.3 cm.

3. The trolley of claim 1 wherein the braking system further comprises a spring retained braking pad that contacts the extended cable when actuated by the actuator.

4. The trolley of claim 3, wherein the braking pad comprises a lining of heat resistant material having a high coefficient of dynamic friction.

5. The trolley of claim 4, wherein the actuator comprises a lever pivotally affixed to the frame; and wherein the lever, when actuated, causes the brake pad to come in contact with the extended cable.

6. The trolley of claim 1, wherein the fabric webbing strap is adjustable to shorten or lengthen the distance from the seat to the frame.

7. The trolley of claim 6, wherein the fabric webbing strap is adjustable to affix to the seat in a swing position.

8. The trolley of claim 7, wherein the seat is flexible.

9. The trolley of claim 6, wherein the seat has a plurality of openings for the fabric webbing strap.

10. The trolley of claim 1, wherein the handle is secured to the frame using grips.

11. A method of carrying a person or object along an extended wire comprising:

attaching a pulley system to a frame, the pulley system adequate to roll along the wire, the pulley system comprising at least two wheels for engaging the extended wire, wherein an outer surface of the wheels does not extend past an outer edge of the frame;

attaching a braking system to the frame to control the speed of the person or object along the wire;

affixing an actuator to the braking system, the actuator comprising a trigger that passes through a slot in the frame that is disposed above the handle adapted to allow a user to engage the actuator with one finger while grasping the handle with two or more fingers attaching a seat using a single fabric webbing strap to the frame, the fabric webbing strap being adjustable to change the distance of the seat from the frame; and attaching a handle to the frame;

wherein the handle is substantially horizontally-centered between the at least two wheels.

12. The method of carrying a person or object along an extended wire of claim 11, further comprising:

affixing a retainment spring to the actuator;

wherein the actuator when activated creates contact between a brake pad of the braking system and the wire.

13. The method of carrying a person or object along an extended wire of claim 11, further comprising:

pivotally affixing a lever to the frame and the actuator.

14. The method of carrying a person or object along an extended wire of claim 11, further comprising:

affixing a heat resistant lining material having a high coefficient of dynamic friction to a brake pad of the braking system.

15. A trolley for traversing a zip line system comprising:

a frame having a plurality of wheels rotatably affixed to the frame, wheels for resting on and engaging a top surface of an extended cable of the zip line system, wherein an outer surface of the wheels does not extend past an outer edge of the frame;

a handle comprising a substantially rigid rod protruding perpendicularly from a side of the frame, the handle having a grip thereon;

a braking system comprising a brake affixed to the frame for engaging an object supporting the trolley in the zip line system, and an actuator, wherein the actuator extends from the frame parallel to the handle, the actuator comprising a trigger that passes through a slot in the frame that is disposed above the handle adapted to allow a user to engage the actuator with one finger while grasping the handle with two or more fingers;

an adjustable seat secured to the frame via a single fabric webbing strap; and wherein the handle is substantially horizontally-centered between the at least two wheels.

* * * * *